United States Patent [19]

Wedertz et al.

[11] Patent Number: 4,688,040

[45] Date of Patent: Aug. 18, 1987

[54] RADAR RETURN SUPPRESSOR

[75] Inventors: Larry D. Wedertz, Mira Loma; Oakley G. Ross, Paso Robles; David H. Kristedja, Diamond Bar, all of Calif.

[73] Assignee: General Dynamics, Pomona Division, Pomona, Calif.

[21] Appl. No.: 676,035

[22] Filed: Nov. 28, 1984

[51] Int. Cl.[4] ..... H01Q 17/00

[52] U.S. Cl. ..... 342/3

[58] Field of Search ..... 343/18 A, 18 E, 18 B; 342/1-4, 13

[56] References Cited

U.S. PATENT DOCUMENTS

| | | | |
|---|---|---|---|
| 2,489,337 | 11/1949 | Sperling | 343/18 |
| 2,881,425 | 4/1959 | Gregory | 343/18 |
| 3,047,860 | 7/1962 | Swallow | 343/18 |
| 3,122,743 | 2/1964 | Vlasic | 343/18 |
| 3,165,751 | 1/1965 | Clark | 343/915 |
| 3,229,290 | 1/1966 | Fisher | 343/18 |
| 3,349,397 | 10/1967 | Rosenthal | 343/18 |
| 3,568,192 | 3/1971 | Dawson | 343/18 |
| 4,539,433 | 9/1985 | Ishino et al. | 343/18 A |

*Primary Examiner*—Thomas H. Tarcza
*Assistant Examiner*—Donald E. Hayes, Jr.
*Attorney, Agent, or Firm*—Neil F. Martin; Edward B. Johnson

[57] ABSTRACT

A radar return suppressor for use in concealing and camouflaging mobile targets such as trucks, artillery and like vehicles. One or more lengths of a support member attachable to the target and components support and position a radar signal attenuator between the target and the anticipated radar source. In one embodiment, the attenuator is a multiplicity of closely spaced flexible plastic strands having radar signal absorbing material dispersed in the strands to form a labyrinth to entrap and absorb the radar signal. In a second embodiment the labyrinth of strands is replaced by an intertwined plastic vine-like structure secured in the support member for absorbing the energy of the radar signal.

5 Claims, 8 Drawing Figures

RADAR RETURN SUPPRESSOR

BACKGROUND OF THE INVENTION

This invention relates to a suppressor for attenuating radar return signals from a target, and more particularly to a field installable suppressor for use with vehicles, tanks, artillery and the like to minimize search and fire control radar return signals. Use of the suppressor will reduce the hazard of detection and/or identification of the target.

In modern warfare radar is extensively used to search for and direct fire against targets in the field. Targets such as tanks, artillery and the like are particularly vulnerable, because of particular characteristics such as gun barrels, projections or cavities that are strongly reflective of electromagnetic energy. In order to hide or camouflage such a target from radar detection and identification, it is desirable to be able to suppress enemy radar return from such targets to the maximum extent possible, and where such suppression is not complete, to minimize characteristic return signals of the targets to avoid or confuse identification. Due to the unpredictable circumstances of combat, it is further desirable to have the means of suppression capable of field installation and adjustment that is light in weight, easily transported and installed, yet durable and relatively inexpensive.

Paints have been employed to reduce radar reflection, but this approach is expensive, subject to chipping, and not capable of ready change to meet existing combat conditions. Camouflage blankets such as disclosed in U.S. Pat. No. 3,349,397 are also available, but they are bulky and difficult to handle, and are not easily adjustable to protect particular features of mobile targets.

Applicant's invention overcomes the foregoing shortcomings while providing an effective way of suppressing radar return signals from vehicles in the field.

SUMMARY OF THE INVENTION

In accordance with the precepts of the invention there is provided a radar suppressor mountable on a target that is interposed between the target, or particular components thereof, and the radar scanning source. In an illustrated embodiment, an elongated flexible and resilient high temperature resistant elastomer support member, of selectable length, is attachable to the target or component. The member supports an electromagnetic energy attenuator. The attenuator is formed of tubular flexible plastic strands attached at one end to the support member and suspended therefrom. The strands have carbon particles dispersed therein for absorbing radar energy, and are closely spaced in the support member in multiple misaligned rows along the length and width of the support member. The strands thus form a labyrinth to entrap and absorb a radar signal. The length of strands is adjustable by cutting them in the field to cover a target component to be protected. For particular target configurations, a variation is illustrated in which the strands are supported at both ends by support members to maintain a desired position and coverage on the target.

In a second illustrated embodiment, the attenuator is formed of flexible plastic vine-like structures with intertwined branches and leaves with carbon particles dispersed therein. The branches are spaced in misaligned rows along and across the width of the support member.

The primary advantage of the invention is to provide a new and improved radar return suppressor for use on mobile armament and vehicles. The suppressor is capable of installation and adjustment in the field. It is light in weight, easily handled and installed, and relatively inexpensive to manufacture. The suppressor is durable and capable of being colored or painted to provide visual camouflage of the vehicle. The suppressor components may be manufactured in long lengths to be stored upon a spool or reel prior to use and cut and connected in suitable lengths for attachment to the target. The suppressor may be installed by being draped about the target component to be protected by stretching and connecting suitable lengths of the support member together, or by direct attachment of the support member to the target by magnets or a suitable adhesive. The material of the suppressor is heat resistant, and therefore compatible with high temperature target components such as firing gun barrels and engine components.

The foregoing, together with other advantages of the invention will become more apparent upon considering the details of construction and operation of the suppressor as they are more fully described in conjunction with the drawings, wherein like numerals referred to like parts throughout and in which.

DETAILED DESCRIPTION OF THE DRAWINGS

Figure 1:
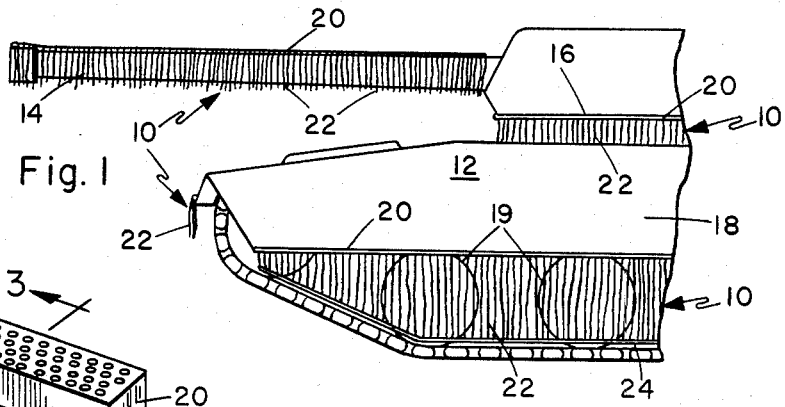
FIG. 1 is a side elevation view illustrating the application of the radar suppressor to portions of a tank.

The employment of radar return suppressor 10 at selected locations on a representative vehicle, namely a tank 12, is illustrated in FIG. 1. The scanning and/or fire control radar is not shown, but may be visualized as directed against the tank 12. As depicted, suppressors 10 are used to mask the tank gun barrel 14, the reflective cavity between the base of the turret 16 and the tank body 18, and the tank tread drive mechanism represented by the drive wheels 19. In this manner tank structures that provide a strong radar return valuable in detecting and identifying tank 12 may be eliminated or suppressed.

The suppressor 10 for the barrel 14 includes a length of a support member 20 secured to the barrel 14. Flexible attenuator strands 22, secured in and projecting from support member 20 are cut to a suitable length to shroud the barrel 14. The latter components will be subsequently described in greater detail. At the tank drive position, the suppressor 10 is illustrated with both an upper support member 20 and a lower support member 24 having the same construction as support member 20. The ends of the strands 22 are attached in support members 20 and 24 to provide increased position stability to the strands 22 at the tank drive mechanism position.

Figure 6:
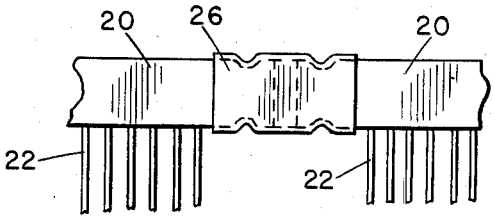
FIG. 6 is a side elevation view showing the interconnection of two ends of a suppressor support member.

The support member 20 of the illustrated embodiment is formed of a high-temperature fluorocarbon elastomer which provides heat resistance and resilience to facilitate mounting. Thus lengths of the support member 20 may be stretched and wrapped around vehicle components and joined together at their ends to secure the suppressor 10 to the vehicle. Use of a crimping sleeve 26 to join together lengths of the support member 20 is illustrated in FIG. 6. Other means of attaching support member lengths to the vehicle will be subsequently described. Use of a heat-resistant plastic for the support member 20 and the strands 22 permits their use in masking vehicle heat sources such as the gun barrel 14 or an engine exhaust system.

Figure 2:
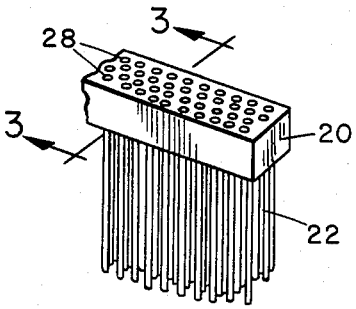
FIG. 2 is a perspective view of a portion of the suppressor.
Figure 3:
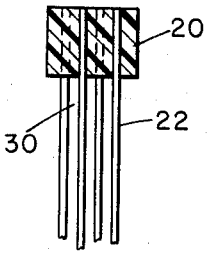
FIG. 3 is a sectional view taken on line 3—3 of FIG. 2.
Figure 4:
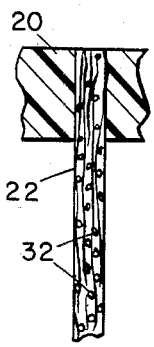
FIG. 4 is an enlarged view of a portion of FIG. 3, showing a single strand.

The detailed structure of a support member 20 and an attenuator strand arrangement is illustrated in FIGS. 2, 3, and 4. As illustrated in FIG. 2, the strands 22 are secured by molding at one end in the support member 20 and project therefrom. The strands are arranged in multiple closely spaced rows 28 along the length and width of the support member 20. Adjacent rows are offset from one another to form a labyrinth of strands 22 to intercept and absorb the radar signal. In the embodiment illustrated four rows of misaligned flexible elastomer tubular shaped strands are molded in the support member 20. The strands have a diameter of $\frac{1}{8}$th to 1/10th of an inch. The inter-strand spacing 30, FIG. 3, is 0.06 inches. It should be understood, however, that other strand configurations and dimensions could be employed to form the attenuating strand labyrinth. FIG. 4 illustrates the structure and composition of a single strand 22. The strand is formed of a flexible and resilient elastomer with resistive semiconductive material 32, such as powdered carbon, dispersed therein to absorb the energy of the incoming and reflected radar signal. The nature and density of dispersion of the absorbing material may be varied to perform the attenuating function most effectively over a particular band of radar frequencies encompassing the anticipated enemy radar frequency.

Figure 5:
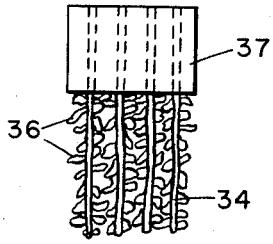
FIG. 5 is an end view of a suppressor support member with an alternative attenuator arrangement.

A second embodiment of the invention is illustrated in FIG. 5 wherein the strands 22 are replaced by vine-like branch members 34 with projecting leaf elements 36 randomly and closely spaced along their length. Branch members 34 and leaves 36 are also formed of plastic with semi-resistive material dispersed therein to form a labyrinth of great density projecting from a support member 37.

Figure 7:
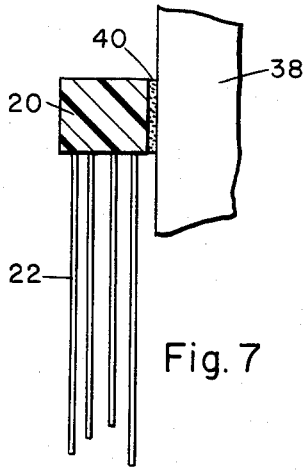
FIG. 7 is a sectional view showing one method of attaching the element to a surface.
Figure 8:
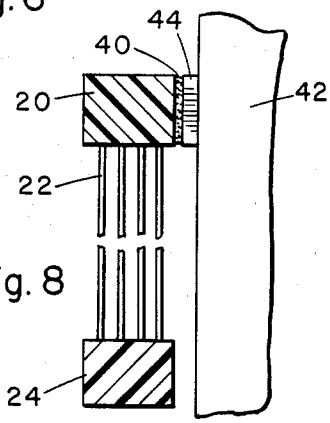
FIG. 8 is a similar sectional view showing another attachment method.

Alternate ways of attaching suppressor sections 10 to a vehicle are illustrated in FIGS. 7 and 8. In FIG. 7, support member 20 is attached to a vehicle component 38 by suitable adhesive material 40. In the embodiment illustrated in FIG. 8, the support member 20 is secured to a vehicle component 42 by magnet 44 which is attached to the support member 20 by a suitable adhesive 40. The latter two methods of attachment increase the versatility of the suppressor 10 by providing for readily attaching or changing the position of suppressor elements on a vehicle in the field to accommodate changed combat conditions.

OPERATION

Use of suppressor sections 10 is described in conjunction with FIG. 1. Lightweight flexible components of the suppressor 10 may be stored in a roll or upon a reel, not shown, in long lengths or otherwise carried in a field support vehicle. When it is desired to protect a target from surveillance or fire control radar, suitable lengths of support member 20 may be cut from the roll and fastened about the base of the vehicle component as indicated by the turret cavity installation. Lengths of support member 20 are shown as having been stretched and joined together by crimping sleeves as illustrated in FIG. 6. The length of the strands 22 and vine-like members 34 are cut to appropriate lengths to shroud the desired vehicle component. Protection of a vehicle component such as the gun barrel 14 is readily achieved by attaching a length of support member 20 along the length of the barrel with an adhesive as illustrated in FIG. 7, and cutting the strands 22 to have a length sufficient to shield the barrel 14. In a similar manner, the tank truck drive may be shielded by securing a length of support member 20 along the length of the tank body 12 above the drive mechanism by using a variation in the design in which the strands are held at the lower end by a second support member 24.

Modifications and variations of the present invention are possible in light of the above disclosure. It is therefore to be understood that within the scope of the pendant claims, the invention may be practiced other than as specifically described.

The invention having been described, what is claimed is:

1. A radar return suppressor for targets, comprising:

an elongated pliable support member attachable to the target and components thereof;

radar attenuator means securable to and projecting from said support member for absorbing radar signal energy, said attenuator comprising:

a plurality of closely spaced flexible strands, said flexible strands further comprising flexible vine-like members having intertwined leafed branches securable in and projecting from said support member in spaced apart rows along the length and width of said support member and said vine-like members and leafed branches having radar signal absorbing material dispersed therein; and means for attaching said support member to the target.

2. A radar return suppressor as recited in claim 1 wherein the attachment means comprises magnets secured to said support member for attaching said support member to the target.

3. A radar return suppressor as recited in claim 1 wherein the attachment means includes means for joining lengths of said support member together for attachment to the target.

4. A radar return suppressor as recited in claim 1 wherein the attachment means comprises a suitable adhesive for securing the support member to the target.

5. A radar return suppressor as recited in claim 1 wherein said support member and said strands are formed from heat resistant plastic for preventing damage thereto from high temperature target components.

* * * * *